US009203152B2

(12) United States Patent
Chou

(10) Patent No.: US 9,203,152 B2
(45) Date of Patent: Dec. 1, 2015

(54) MULTI-BAND ANTENNA AND PORTABLE ELECTRONIC DEVICE THEREOF

(71) Applicant: Wistron Corporation, New Taipei (TW)

(72) Inventor: Chen-Yu Chou, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 168 days.

(21) Appl. No.: 14/061,768

(22) Filed: Oct. 24, 2013

(65) Prior Publication Data

US 2015/0061939 A1 Mar. 5, 2015

(30) Foreign Application Priority Data

Sep. 3, 2013 (TW) ..... 102216565 U

(51) Int. Cl.

| | |
|---|---|
| ***H01Q 1/24*** | (2006.01) |
| ***H01Q 5/371*** | (2015.01) |
| ***H01Q 9/42*** | (2006.01) |
| ***H01Q 5/378*** | (2015.01) |

(52) U.S. Cl.

CPC ..... *H01Q 5/371* (2015.01); *H01Q 1/243* (2013.01); *H01Q 5/378* (2015.01); *H01Q 9/42* (2013.01)

(58) Field of Classification Search

CPC ..... H01Q 1/243; H01Q 9/42; H01Q 5/371; H01Q 5/378; H01Q 9/0421

USPC ..... 343/702, 700 MS, 826, 828, 829, 830, 343/846

See application file for complete search history.

(56) References Cited

U.S. PATENT DOCUMENTS

| | | | | |
|---|---|---|---|---|
| 7,701,401 | B2 * | 4/2010 | Suzuki et al. | 343/702 |
| 7,719,470 | B2 * | 5/2010 | Wang et al. | 343/700 MS |
| 8,035,563 | B2 * | 10/2011 | Ishimiya | 343/700 MS |
| 8,847,828 | B1 * | 9/2014 | Lee et al. | 343/702 |

* cited by examiner

*Primary Examiner* — Michael C Wimer
(74) *Attorney, Agent, or Firm* — Winston Hsu; Scott Margo

(57) ABSTRACT

A multi-band antenna is disposed on a circuit board having a feeding line. The feeding line has a signal-transmitting end and a ground end. The multi-band antenna includes a feeding portion coupled to the signal-transmitting end, a ground portion coupled to the ground end, an intermediate-frequency sheet section extending from the feeding portion toward a first direction, a low-frequency arm, and a high-frequency arm. The low-frequency arm extends from a side of the intermediate-frequency sheet section toward a second direction opposite to the first direction. The high-frequency arm includes first and second bending portions. The first bending portion extends from the side of the intermediate-frequency sheet section toward the second direction so as to connect to the ground portion. The first bending portion has a recess. The second bending portion extends into the recess for transceiving signals within a first frequency band cooperatively with the first bending portion.

14 Claims, 2 Drawing Sheets

MULTI-BAND ANTENNA AND PORTABLE ELECTRONIC DEVICE THEREOF

BACKGROUND OF THE INVENTION

1. Field of the Invention

The present invention relates to a multi-band antenna, and more specifically, to a multi-band antenna having a high-frequency arm formed by a first bending portion having a recess and a second bending portion extending from the first bending portion to the recess and a portable electronic device thereof.

2. Description of the Prior Art

In general, since a wireless communication device could transmit signals without a transmitting entity (e.g. an optical fiber or a cable), it could be a preferable signal transmitting tool. With development of wireless communication technology, a portable electronic device usually has a wireless communication function in recent years, such as a mobile phone.

In the aforesaid portable electronic device, an antenna for transceiving wireless electric waves is one of the most important components. Due to the miniaturization trend of the portable electronic device in recent years, the antenna is required to be compact and must be designed to occupy less space so as to be advantageous to the thinning design of the portable electronic device. In addition, as the bit rate of wireless signals increases, antenna bandwidth requirements increase as well. Thus, how to increase the bandwidth of the antenna in the limited space of the portable electronic device could be a concern in the structural design of the antenna.

SUMMARY OF THE INVENTION

The present invention provides a multi-band antenna disposed on a circuit board. The circuit board has a feeding line. The feeding line has a signal-transmitting end and a ground end. The multi-band antenna includes a feeding portion, a ground portion, an intermediate-frequency sheet section, a low-frequency arm, and a high-frequency arm. The feeding portion is coupled to the signal-transmitting end. The ground portion is coupled to the ground end. The intermediate-frequency sheet section extends from the feeding portion toward a first direction. The low-frequency arm extends from a side of the intermediate-frequency sheet section toward a second direction opposite to the first direction. The high-frequency arm includes a first bending portion and a second bending portion. The first bending portion extends from the side of the intermediate-frequency sheet section toward the second direction so as to connect to the ground portion. The first bending portion has a recess. The second bending portion extends from a position where the first bending portion is connected to the ground portion and extends into the recess. The second bending portion is used for transceiving signals within a first frequency band cooperatively with the first bending portion.

The present invention further provides a portable electronic device including a circuit board and a multi-band antenna. The circuit board has a feeding line. The feeding line has a signal-transmitting end and a ground end. The multi-band antenna is disposed on the circuit board. The multi-band antenna includes a feeding portion, a ground portion, an intermediate-frequency sheet section, a low-frequency arm, and a high-frequency arm. The feeding portion is coupled to the signal-transmitting end. The ground portion is coupled to the ground end. The intermediate-frequency sheet section extends from the feeding portion toward a first direction. The low-frequency arm extends from a side of the intermediate-frequency sheet section toward a second direction opposite to the first direction. The high-frequency arm includes a first bending portion and a second bending portion. The first bending portion extends from the side of the intermediate-frequency sheet section toward the second direction so as to connect to the ground portion. The first bending portion has a recess. The second bending portion extends from a position where the first bending portion is connected to the ground portion and extends into the recess. The second bending portion is used for transceiving signals within a first frequency band cooperatively with the first bending portion.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
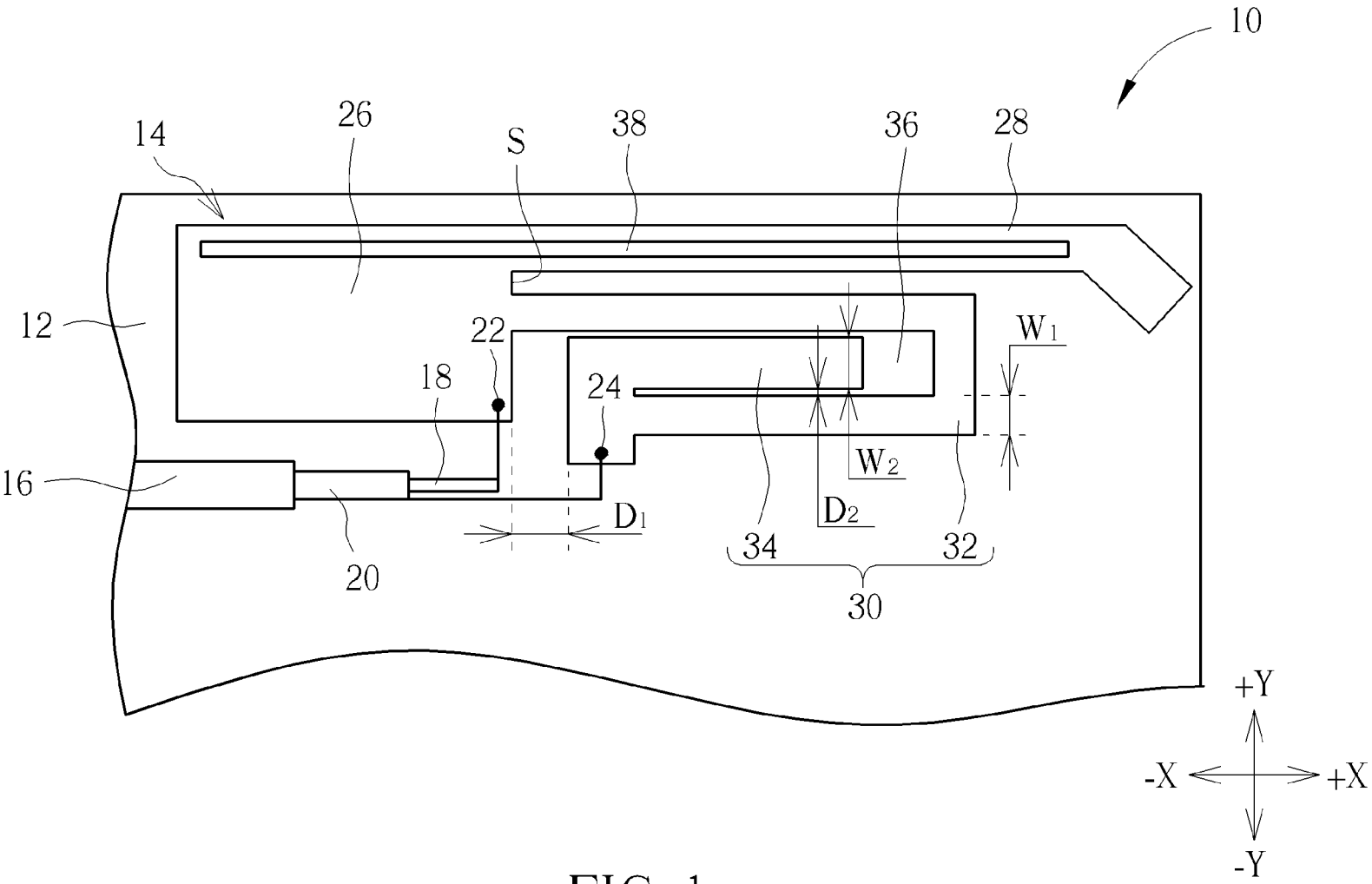
FIG. 1 is a partial diagram of a portable electronic device according to an embodiment of the present invention.

Please refer to FIG. 1, which is a partial diagram of a portable electronic device 10 according to an embodiment of the present invention. The portable electronic device 10 includes a circuit board 12 and a multi-band antenna 14. The circuit board 12 has a feeding line 16. The feeding line 16 could be preferably a coaxial cable and have a signal transmitting end 18 and a ground end 20. The multi-band antenna 14 is disposed on the circuit board 12. The multi-band antenna includes a feeding portion 22, a ground portion 24, an intermediate-frequency sheet section 26, a low-frequency arm 28, and a high-frequency arm 30. As shown in FIG. 1, the feeding portion 22 is coupled to the signal transmitting end 18 and the ground portion 24 is coupled to the ground end 20 for establishing signal transmission between the circuit board 12 and the multi-band antenna 14. A distance $D_1$ between the feeding portion 22 and the ground portion 24 is within a range from 3 mm to 5 mm, but not limited thereto.

As shown in FIG. 1, the intermediate-frequency sheet section 26 extends from the feeding portion 22 toward an −X-axis direction, and the low-frequency arm 28 extends from a side S of the intermediate-frequency sheet section 26 corresponding to the feeding portion 22 toward an +X-axis direction. That is, the intermediate-frequency sheet section 26 and the low-frequency arm 28 extend toward the opposite directions for transceiving signals within an intermediate-frequency band and a low-frequency band respectively. The high-frequency arm 30 includes a first bending portion 32 and a second bending portion 34. The first bending portion 32 extends from the side S of the intermediate-frequency sheet section 26 toward the +X-axis direction as shown in FIG. 1 so as to connect to the ground portion 24. The first bending portion 32 has a recess 36. The second bending portion 34 extends from a position where the first bending portion 32 is connected to the ground portion 24 and extends into the recess 36. The second bending portion 34 is used for transceiving signals within a high-frequency band cooperatively with the first bending portion 32.

To be noted, the size ratio of the intermediate-frequency sheet section 26 to the low-frequency arm 28 could vary with the practical bandwidth of the multi-band antenna 14 and be not limited to the size ratio as shown in FIG. 1. Furthermore, in this embodiment, a width $W_1$ of the first bending portion 32 is within a range from one third to two thirds of a width $W_2$ of the second bending portion 34 and a distance $D_2$ between the second bending portion 34 and the first bending portion 32 is within a range from 0.3 mm to 0.5 mm, but not limited thereto. That is, the distance $D_2$ between the second bending portion 34 and the first bending portion 32 and the ratio relationship of the width $W_1$ of the first bending portion 32 and the width $W_2$ of the second arm portion 34 could vary with the practical application of the multi-band antenna 14. In other words, all designs in which an antenna has a high-frequency arm formed by a first bending portion having a recess and a second bending portion extending from the first bending portion to the recess, could fall within the scope of the present invention.

Furthermore, in this embodiment, the portable electronic device 10 could further include a bandwidth expanding arm 38. The bandwidth expanding arm 38 could adopt a conventional antenna arm adding design to be coupled to the intermediate-frequency sheet section 26 and the low-frequency arm 28. For example, the bandwidth expanding arm 38 could be disposed above the intermediate-frequency sheet section 26 and the low-frequency arm 28 in a three-point welding manner for expanding the bandwidth of the intermediate-frequency sheet section 26 and the bandwidth of the low-frequency arm 28.

Figure 2:
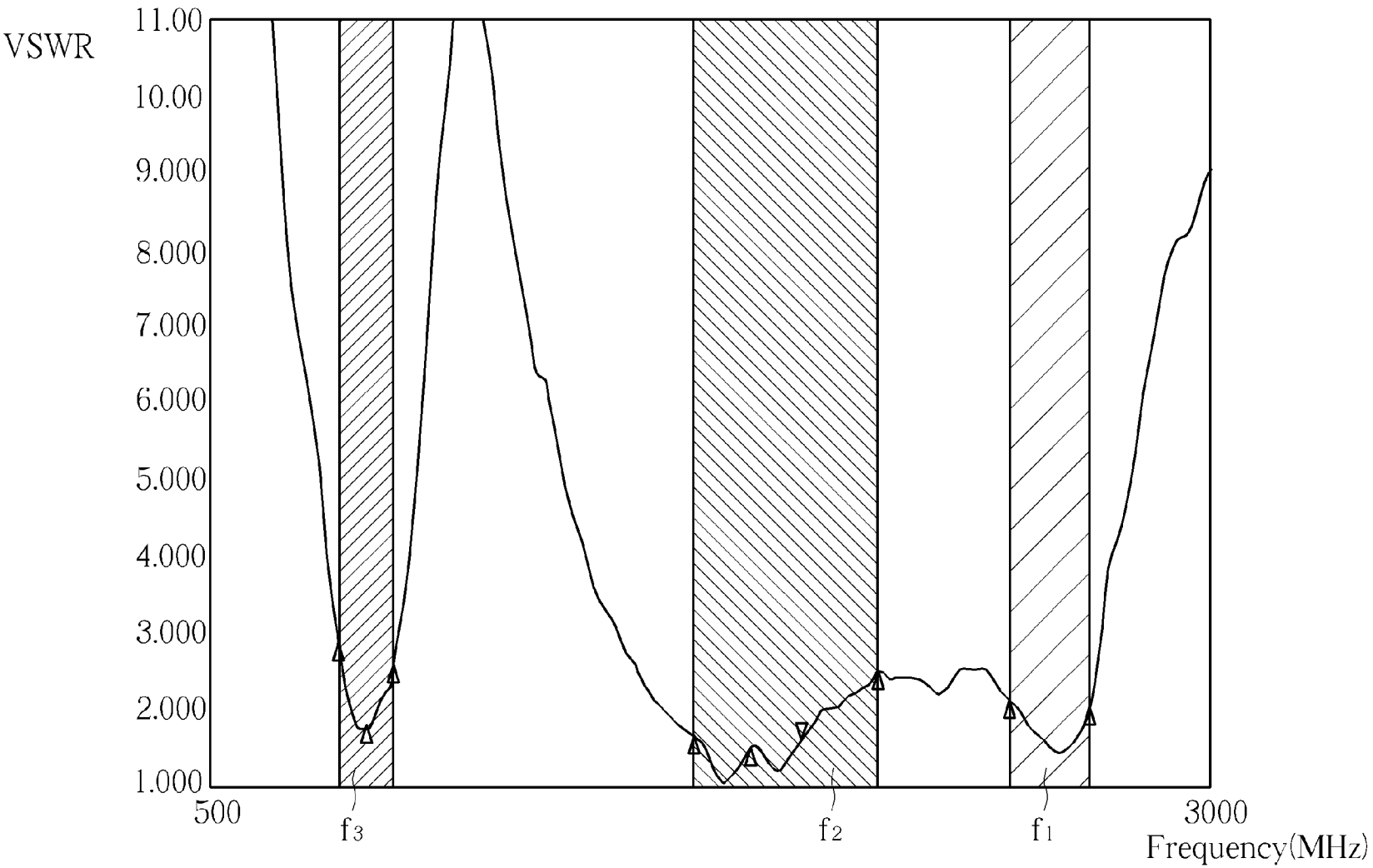
FIG. 2 is a VSWR (Voltage Standing Wave Ratio) diagram of a multi-band antenna in FIG. 1.

More detailed description for the bandwidth of the multi-band antenna 14 is provided as follows. Please refer to FIG. 1 and FIG. 2. FIG. 2 is a VSWR diagram of the multi-band antenna 14 in FIG. 1. As shown in FIG. 2, the multi-band antenna 14 could utilize the structure formed by the first bending portion 32 and the second bending portion 34 as shown in FIG. 1, the intermediate-frequency sheet section 26, and the low-frequency arm 28 to transceiving signals within a first frequency band $f_1$, a second frequency band $f_2$, and a third frequency band $f_3$ respectively. In this embodiment, the first frequency band $f_1$ is within a range from 2.5 GHz to 2.7 GHz (i.e. the high-frequency band), the second frequency $f_2$ is within a range from 1.71 GHz to 2.17 GHz (i.e. the intermediate-frequency band), and the third frequency band $f_3$ is within a range from 824 MHz to 960 MHz (i.e. the low-frequency band).

In summary, the multi-band antenna of the present invention utilize the high-frequency arm having the second bending portion extending from the first bending portion to the recess of the first bending portion, the intermediate-frequency sheet section, and the low-frequency arm, to transceive multi-band signals and achieve the purpose that the inner space of the multi-band antenna could be more effectively used, so as to be advantageous to the thinning design of the portable electronic device and further expand the bandwidth of the multi-band antenna.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A multi-band antenna disposed on a circuit board, the circuit board having a feeding line, the feeding line having a signal-transmitting end and a ground end, the multi-band antenna comprising:

a feeding portion coupled to the signal-transmitting end;

a ground portion coupled to the ground end;

an intermediate-frequency sheet section extending from the feeding portion toward a first direction;

a low-frequency arm extending from a side of the intermediate-frequency sheet section toward a second direction opposite to the first direction; and a high-frequency arm comprising:

a first bending portion extending from the side of the intermediate-frequency sheet section toward the second direction so as to connect to the ground portion, the first bending portion having a recess; and a second bending portion extending from a position where the first bending portion is connected to the ground portion, the second bending portion extending into the recess of first bending portion along the second direction, the second bending portion being for transceiving signals within a first frequency band cooperatively with the first bending portion.

2. The multi-band antenna of claim 1, wherein a width of the first bending portion is within a range from one third to two thirds of a width of the second bending portion.

3. The multi-band antenna of claim 2, wherein a distance between the second bending portion and the first bending portion is within a range from 0.3 mm to 0.5 mm.

4. The multi-band antenna of claim 3, wherein the first frequency band is within a range from 2.5 GHz to 2.7 GHz.

5. The multi-band antenna of claim 1 further comprising:

a bandwidth expanding arm coupled to the intermediate-frequency sheet section and the low-frequency arm, the bandwidth expanding arm being for transceiving signals within a second frequency band cooperatively with the intermediate-frequency sheet section and transceiving signals within a third frequency band cooperatively with the low-frequency arm.

6. The multi-band antenna of claim 5, wherein the second frequency band is within a range from 1.71 GHz to 2.17 GHz, and the third frequency band is within a range from 824 MHz to 960 MHz.

7. The multi-band antenna of claim 1, wherein a distance between the feeding portion and the ground portion is within a range from 3 mm to 5 mm.

8. A portable electronic device comprising:

a circuit board having a feeding line, the feeding line having a signal-transmitting end and a ground end; and a multi-band antenna disposed on the circuit board, the multi-band antenna comprising:

a feeding portion coupled to the signal-transmitting end;

a ground portion coupled to the ground end;

an intermediate-frequency sheet section extending from the feeding portion toward a first direction;

a low-frequency arm extending from a side of the intermediate-frequency sheet section toward a second direction opposite to the first direction; and a high-frequency arm comprising:

a first bending portion extending from the side of the intermediate-frequency sheet section toward the second direction so as to connect to the ground portion, the first bending portion having a recess; and a second bending portion extending from a position where the first bending portion is connected to the ground portion, the second bending portion extending into the recess of first bending portion along the second direction, the second bending portion being for transceiving signals within a first frequency band cooperatively with the first bending portion.

9. The portable electronic device of claim 8, wherein a width of the first bending portion is within a range from one third to two thirds of a width of the second bending portion.

10. The portable electronic device of claim 9, wherein a distance between the second bending portion and the first bending portion is within a range from 0.3 mm to 0.5 mm.

11. The portable electronic device of claim 10, wherein the first frequency band is within a range from 2.5 GHz to 2.7 GHz.

12. The portable electronic device of claim 8 further comprising:

a bandwidth expanding arm coupled to the intermediate-frequency sheet section and the low-frequency arm, the bandwidth expanding arm being for transceiving signals within a second frequency band cooperatively with the intermediate-frequency sheet section and transceiving signals within a third frequency band cooperatively with the low-frequency arm.

13. The portable electronic device of claim 12, wherein the second frequency band is within a range from 1.71 GHz to 2.17 GHz, and the third frequency band is within a range from 824 MHz to 960 MHz.

14. The portable electronic device of claim 8, wherein a distance between the feeding portion and the ground portion is within a range from 3 mm to 5 mm.

* * * * *